US012222131B2

(12) United States Patent
Sun et al.

(10) Patent No.: US 12,222,131 B2
(45) Date of Patent: Feb. 11, 2025

(54) BOX COVER, WATER BOX, HUMIDIFICATION APPARATUS, AND AIR BLOWING DEVICE

(71) Applicants: GD MIDEA ENVIRONMENT APPLIANCES MFG CO., LTD., Zhongshan (CN); MIDEA GROUP CO., LTD., Foshan (CN)

(72) Inventors: Zhiping Sun, Zhongshan (CN); Xin Yang, Zhongshan (CN); Wenpo Chen, Zhongshan (CN); Hanfei Chen, Zhongshan (CN); Qing Wang, Zhongshan (CN); Wenbo Du, Zhongshan (CN); Mingbi Li, Zhongshan (CN); Chengbo Tan, Zhongshan (CN)

(73) Assignees: GD MIDEA ENVIRONMENT APPLIANCES MFG CO., LTD., Zhongshan (CN); MIDEA GROUP CO., LTD., Foshan (CN)

( * ) Notice: Subject to any disclaimer, the term of this patent is extended or adjusted under 35 U.S.C. 154(b) by 530 days.

(21) Appl. No.: 17/622,865

(22) PCT Filed: Sep. 27, 2019

(86) PCT No.: PCT/CN2019/108692
§ 371 (c)(1),
(2) Date: Dec. 27, 2021

(87) PCT Pub. No.: WO2021/017146
PCT Pub. Date: Feb. 4, 2021

(65) Prior Publication Data

US 2022/0243950 A1 Aug. 4, 2022

(30) Foreign Application Priority Data

Aug. 1, 2019 (CN) ..... 201921236435.0

(51) Int. Cl.
*F24F 13/20* (2006.01)
*F04D 25/08* (2006.01)
(Continued)

(52) U.S. Cl.
CPC ..... *F24F 13/20* (2013.01); *F04D 25/08* (2013.01); *F24F 6/12* (2013.01); *F24F 6/14* (2013.01);
(Continued)

(58) Field of Classification Search
CPC ..... B01F 23/2133; F04D 25/08; F24F 6/12; F24F 6/14; F24F 13/082; F24F 13/20; F24F 2006/008
(Continued)

(56) References Cited

U.S. PATENT DOCUMENTS 4,257,989 A * 3/1981 Nishikawa ..... B05B 17/0615 210/287
5,217,165 A * 6/1993 Takahashi ..... B05B 17/0615 261/81
(Continued)

FOREIGN PATENT DOCUMENTS

CN 201636039 U 11/2010
CN 102003762 A 4/2011
(Continued)

OTHER PUBLICATIONS

English Abstract of JP 54-68038 (Year: 1979).*
(Continued)

*Primary Examiner* — Charles S Bushey

(57) ABSTRACT

Provided are a box cover, a water box, a humidification apparatus, and an air blowing device, the box cover including a cover body and a mist outlet passageway running through the cover body, the cover body and the mist outlet passageway are integrally formed. By means of integrally
(Continued)

forming the cover body and the mist outlet passageway, and significant reduction of the time required for assembly of a mist outlet tube, while also avoiding the occurrence of water leakage at the joint of the mist outlet tube.

10 Claims, 4 Drawing Sheets

(51) Int. Cl.
*F24F 6/12* (2006.01)
*F24F 6/14* (2006.01)
*F24F 13/08* (2006.01)
*F24F 6/00* (2006.01)

(52) U.S. Cl.
CPC ..... *F24F 13/082* (2013.01); *F24F 2006/008* (2013.01)

(58) Field of Classification Search
USPC ..... 261/72.1, 81, DIG. 48
See application file for complete search history.

(56) References Cited

U.S. PATENT DOCUMENTS

| | | | | | |
|---|---|---|---|---|---|
| 5,300,260 | A * | 4/1994 | Keshet | B05B 17/0615 | 261/81 |
| 5,464,572 | A * | 11/1995 | Bonzi | B05B 17/0669 | 361/231 |
| 5,693,266 | A * | 12/1997 | Jung | B01F 23/2133 | 261/80 |
| 5,916,490 | A * | 6/1999 | Cho | C02F 1/4602 | 261/81 |
| 6,244,576 | B1 * | 6/2001 | Tsai | F24F 6/02 | 261/DIG. 65 |
| 7,654,508 | B2 * | 2/2010 | Wegner | F24F 6/14 | 261/78.2 |
| 2006/0131764 | A1 * | 6/2006 | Weon | F24F 6/02 | 261/81 |
| 2007/0278702 | A1 * | 12/2007 | French | F24F 6/02 | 261/81 |
| 2018/0335221 | A1 | 11/2018 | Cho et al. | | |

FOREIGN PATENT DOCUMENTS

| | | | | | |
|---|---|---|---|---|---|
| CN | 202048004 | U | | 11/2011 | |
| CN | 104807124 | A | | 7/2015 | |
| CN | 104654504 | A | * | 5/2016 | |
| CN | 108397848 | A | | 8/2018 | |
| DE | 4122389 | A1 | * | 1/1993 | B05B 17/0615 |
| JP | S5334261 | U | | 3/1978 | |
| JP | S53132758 | U | | 10/1978 | |
| JP | 54-68038 | | * | 5/1979 | |
| JP | 54-68040 | | * | 5/1979 | |
| JP | S55174540 | U | | 12/1980 | |
| JP | S6441030 | U | | 3/1989 | |
| JP | 3-152326 | | * | 6/1991 | |
| JP | 3-225133 | | * | 10/1991 | |
| JP | 3146538 | U | | 11/2008 | |
| KR | 20060021783 | A | | 3/2006 | |

OTHER PUBLICATIONS

English Abstract of JP 54-68040 (Year: 1979).*
English Abstract of JP 3-152326 (Year: 1991).*
English Abstract of JP 3-225133 (Year: 1991).*
English Abstract of DE 4122389 A1 (Year: 1993).*
Partial English Translation of CN 104654504 A (Year: 2015).*
First Office Action issued on Jan. 30, 2023 regarding the JP counterpart 2022-502824.
International Search Report of PCT No. PCT/CN2019/108692, Apr. 2020.

* cited by examiner

BOX COVER, WATER BOX, HUMIDIFICATION APPARATUS, AND AIR BLOWING DEVICE

CROSS-REFERENCES TO RELATED APPLICATIONS

The present disclosure is a national phase application of International Application No. PCT/CN2019/108692, filed on Sep. 27, 2019, which claims the priority to Chinese Patent Application No. 201921236435.0, filed on Aug. 1, 2019, the entireties of which are herein incorporated by reference.

FIELD

The disclosure relates to the field of air conditioning, and in particular to a box cover, a water box, a humidifying device and a blowing apparatus.

BACKGROUND

A conventional ultrasonic humidifying device used in a heater generates water mist in a water box through an oscillating plate, then guides the water mist toward a mist outlet through a mist output pipe, and sprays the water mist to the outside of the heater through a mist output hole on a housing of the heater. The mist output pipe of this humidifying device is generally a hose or other pipes. One end of the mist output pipe is connected with the mist outlet by joint, and another end of the mist output pipe is connected with the water box by joint. The leakage preventing treatment is needed at the joint by sealing or the like.

However, the assembly of the mist output pipe is cumbersome. In a case that the seal at the interface is not good, water leakage may occur, to affect the reliability of the product.

SUMMARY

In view of the above, embodiments of the disclosure are intended to provide a box cover, a water box, a humidifying device and a blowing apparatus that have a water leakage preventing structure.

One embodiment of the disclosure provides a box cover for a water box of a humidifying device. The box cover includes a cover body and a mist output channel penetrating through the cover body.

The cover body is integrally formed with the mist output channel.

Further, the box cover further includes a mist outlet. One end of the mist output channel is in communication with the cover body, another end of the mist output channel is in communication with the mist outlet. The mist output channel is integrally formed with the mist outlet.

Further, a cross section of the mist output channel tapers from said one end in communication with the cover body to said another end where the mist outlet is located.

Further, a protrusion provided with a first receiving cavity is formed on the cover body. The first receiving cavity is in communication with the mist output channel.

Further, the box cover further includes multiple drainage ribs. The multiple drainage ribs are arranged on an inner surface of a top of the protrusion; and/or The mist output channel is located on one side of the protrusion. The protrusion includes a first top surface and a second top surface. One side of the second top surface is connected with the first top surface, and another side of the second top surface is connected with a side wall of the mist output channel. The second top surface is inclined downward from said one side connected with the first top surface to said another side connected with the side wall of the mist output channel.

Further, the multiple drainage ribs are radially distributed.

One embodiment of the disclosure provides a water box of a humidifying device. The water box includes a box body, an air-out duct and a box cover as described above.

The box body is provided with a second receiving cavity and an atomizing assembly mounting hole in communication with the second receiving cavity.

The box cover is capped on the box body, the mist output channel and the air-out duct is in communication with the second receiving cavity. An air outlet of the air-out duct is disposed higher than a highest water level of the second receiving cavity.

Further, an air-in end of the air-out duct penetrates through a bottom of the second receiving cavity, and an air-out end of the air-out duct is arranged corresponding to an inner surface of the cover body; and/or the air-out duct is located on one side of the atomizing assembly mounting hole and the mist output channel is located on another side of the atomizing assembly mounting hole transversely opposite to said one side, and the air outlet of the air-out duct faces away from the mist output channel.

Another embodiment of the disclosure provides a humidifying device including an atomizing assembly, a water tank, a fan assembly and a water box as described above.

The atomizing assembly is disposed at the atomizing assembly mounting hole.

A water-passage hole is formed on the water box, and the water tank is in communication with the second receiving cavity through the water-passage hole.

The fan assembly is in communication with the air-out duct.

Further, the atomizing assembly mounting hole is located at a bottom of the second receiving cavity. A maximum width of the first receiving cavity and a maximum width of the second receiving cavity are adapted to a maximum outer diameter of the atomizing assembly mounting hole. A maximum length of the first receiving cavity is greater than the maximum width of the first receiving cavity.

Further, the blowing apparatus includes a housing and a humidifying device as described above. The humidifying device is arranged in the housing, a mist output hole is arranged on the housing, and the mist output channel is in communication with the mist output hole.

Embodiments of the disclosure provide a box cover, a water box, a humidifying device and a blowing apparatus. The cover body is integrally formed with the mist output channel, so that the time for assembling a mist output pipe is greatly saved, and the occurrence of water leakage at the joint of the mist output pipe is also avoided.

DETAILED DESCRIPTION OF THE DISCLOSURE

It should be noted that the embodiments of the disclosure may be combined with each other without conflict, and the description of the detailed description should be understood as an explanation of the disclosure and should not be construed as unduly limiting the disclosure.

Figure 1:
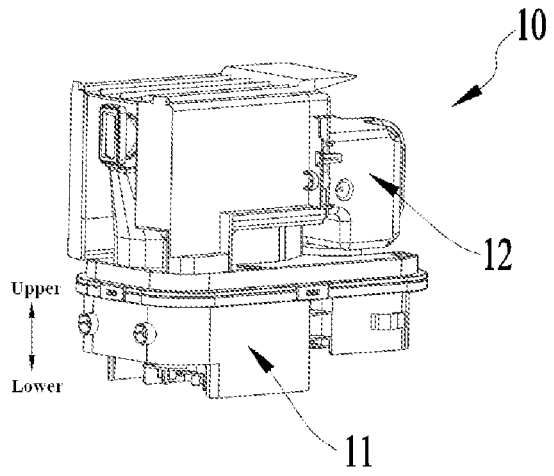
FIG. 1 is a schematic diagram of a humidifying device according to an embodiment of the disclosure.

In the description of the embodiments of the disclosure, "upper", "lower", "top" and "bottom" orientations or positional relationships are based on an orientations or positional relationships shown in FIG. 1. It should be understood that these orientation terms are intended solely for ease of describing the disclosure and simplifying the description, and are not intended to indicate or imply that the devices or elements must have a particular orientation, be constructed and operated in a particular orientation. Therefore, these orientation terms are not to be understood as limiting the disclosure.

One embodiment of the disclosure provides a box cover 110, and the box cover 110 is mainly used for a water box 11 of a humidifying device 10. For ease of description, in an embodiment of the disclosure, an example in which the humidifying device 10 is applied to a blowing apparatus is described. In one embodiment, an example in which the blowing apparatus is a fan heater is described. It is understood that the blowing apparatus can also be of other types. The humidifying device 10 of the embodiment of the disclosure can also be used for other devices such as a humidifier.

Figure 2:
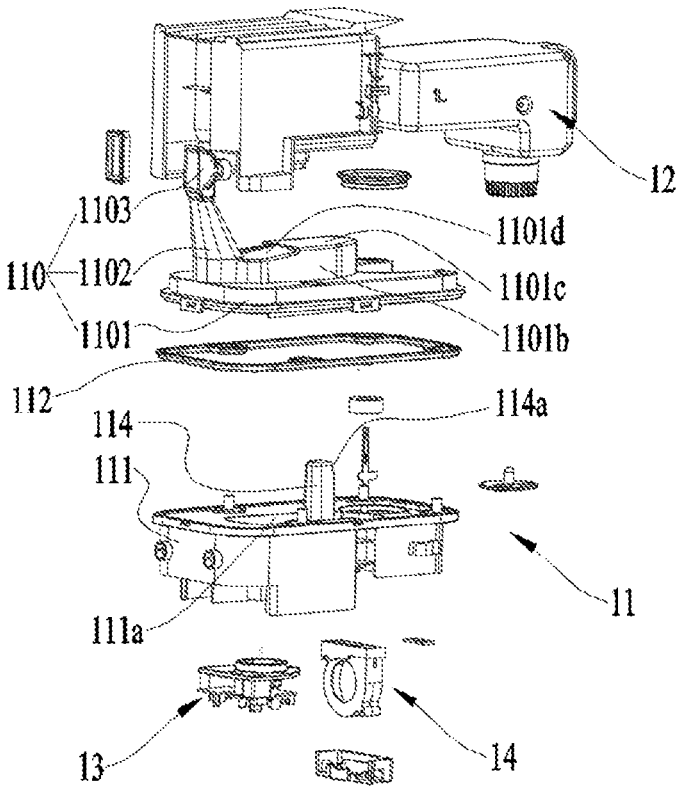
FIG. 2 is an exploded schematic diagram of FIG. 1.
Figure 3:
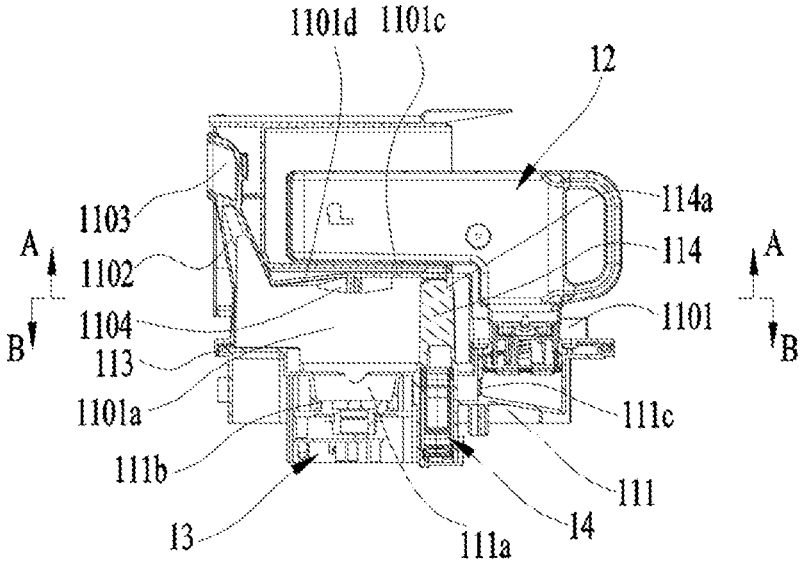
FIG. 3 is a half cross-sectional view of FIG. 1.
Figure 8:
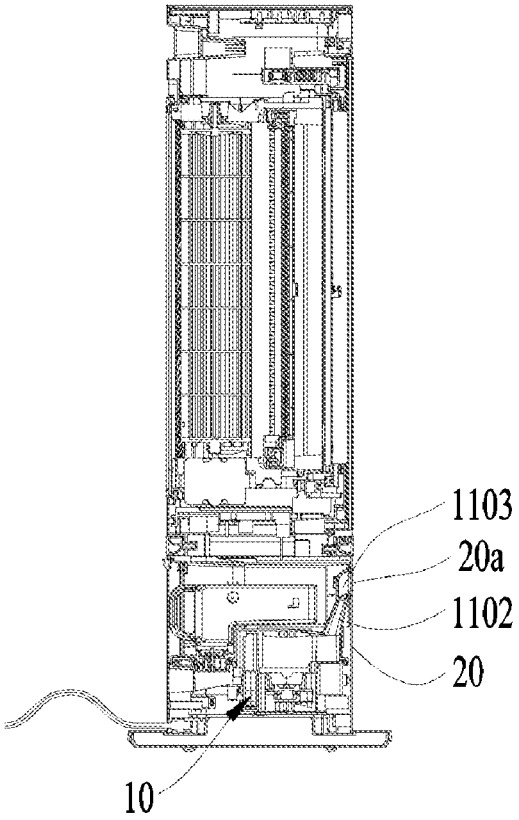
FIG. 8 is a half cross-sectional view of FIG. 7.

Referring to FIG. 2, FIG. 3 and FIG. 8, the box cover 110 of the embodiment of the disclosure includes a cover body 1101 and a mist output channel 1102 penetrating through the cover body 1101. The cover body 1101 is integrally formed with the mist output channel 1102. Water mist generated by an atomizing assembly 13 can be discharged to the outside of the fan heater directly through the mist output channel 1102, without providing a hose or other pipes for guiding the water mist toward a mist output hole 20*a* on a housing 20 of the fan heater, to save the assembly process for the hose or other pipes, and reducing the possibility of water leakage while greatly improving the reliability of the product.

The humidifying device 10 of the embodiment of the disclosure is an ultrasonic humidifying device. The atomizing assembly 13 includes an oscillating plate 131. It is understood that different types of atomizing assemblies 13 may be selected according to different types of humidifying devices 10. For example, in another embodiment (not shown), the humidifying device 10 may be an evaporative type of humidifying device, and the atomizing assembly 13 may be a heating atomizing assembly provided with a heating tube as long as the atomizing assembly 13 can generate water mist from liquid water.

With reference to FIG. 2 and FIG. 3, in the embodiment of the disclosure, the box cover 110 further includes a mist outlet 1103. One end of the mist output channel 1102 is in communication with the cover body 1101, and another end of the mist output channel 1102 is in communication with the mist outlet 1103. The mist output channel 1102 is integrally formed with the mist outlet 1103. The mist outlet 1103 facilitates spraying water mist out of the housing 20 at a preset angle, and also facilitates communication between the mist output channel 1102 and the mist output hole 20*a* (see FIG. 7) on the housing 20 of the fan heater, to further reduce the possibility of water leakage at the joint of the mist output channel 1102 and the mist output hole 20*a*.

In an embodiment of the disclosure, a cross section of the mist output channel 1102 tapers from said one end in communication with the cover body 1101 to said another end where the mist outlet 1103 is located. That is, the mist output channel 1102 is designed to, along the flow direction of the water mist, be a structure with the cross section gradually changing from large to small. The structure has a function of accelerating the flow speed of the water mist, and enables the water mist sprayed from the mist output hole 20*a* to be sprayed higher, so that the water mist can be more fully mixed with the hot air flow generated by the fan heater.

In an embodiment of the disclosure, with reference to FIG. 2 and FIG. 3, a protrusion 1101*b* provided with a first receiving cavity 1101*a* is formed on the cover body 1101. The first receiving cavity 1101*a* is in communication with the mist output channel 1102. The arrangement of the protrusion 1101*b* may increase the capacity of the water box 11 as much as possible, to have more space for the generated water mist, and to facilitate installing a water tank 12 of the humidifying device 10 or the like. In another embodiment, the protrusion 1101*b* may not be provided. For example, the cover body 1101 may be only a flat cover plate. The water mist is generated directly in a second receiving cavity 111*a*, and then guided toward the outside of the housing 20 through the mist output channel 1102.

Figure 5:
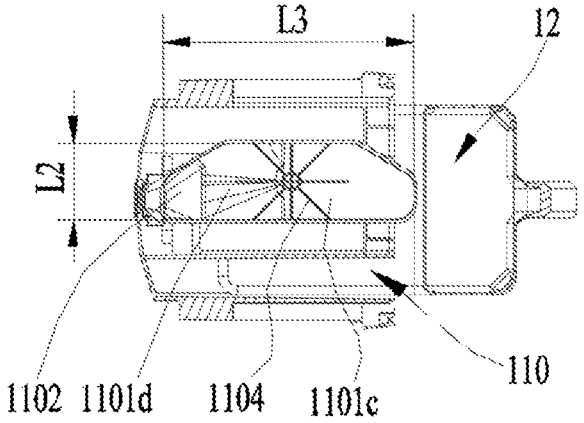
FIG. 5 is a cross-sectional view taken along the line A-A shown in FIG. 3.

In an embodiment of the disclosure, referring to FIG. 3 and FIG. 5, the box cover 110 further includes multiple drainage ribs 1104. The multiple drainage ribs 1104 are arranged on an inner surface of a top of the protrusion 1101*b*. In practice, the water mist column generated by the oscillating plate 131 impinges on an inner wall of the top surface of the protrusion 1101*b*. On the one hand, by providing the drainage ribs 1104, liquid water which is not atomized can be drained to a side wall of the first receiving cavity 1101*a* and then returned back to the liquid water generating the water mist column, whereby the sound of water droplets can be reduced, so that the humidifying device 10 is more quiet during operation, and the water can be prevented from splashing to an air outlet 114*a* of an air-out duct 114. On the other hand, the drainage ribs 1104 are generally disposed just above the oscillating plate 131, whereby the water mist column generated by the oscillating plate can be prevented from "blackening" an outer surface of the box cover 110. In an embodiment of the disclosure, the multiple drainage ribs 1104 are radially distributed, whereby the liquid water which is not atomized can be conveniently drained around. It is understood that the arrangement of the multiple drainage ribs 1104 is not limited to the radial distribution, as long as the drainage function can be performed.

In an embodiment of the disclosure, with reference to FIG. 2 and FIG. 3, the mist output channel 1102 is located on one side of the protrusion 1101*b*. The protrusion 1101*b* includes a first top surface 1101*c* and a second top surface 1101*d*. One side of the second top surface 1101*d* is connected with the first top surface 1101*c*, and another side of the second top surface 1101*d* is connected with a side wall of the mist output channel 1102. The second top surface 1101*d* is inclined downward from said one side connected with the first top surface 1101*c* to said another side connected with the side wall of the mist output channel 1102. The inclined second top surface 1101*d* is also provided for draining the liquid water which is not atomized to the side wall of the first receiving cavity 1101*a* and then returning said liquid water back to the liquid water generating the water mist column. The second top surface 1101*d* and the drainage ribs 1104 can cooperate with each other to achieve a better effect.

Figure 6:
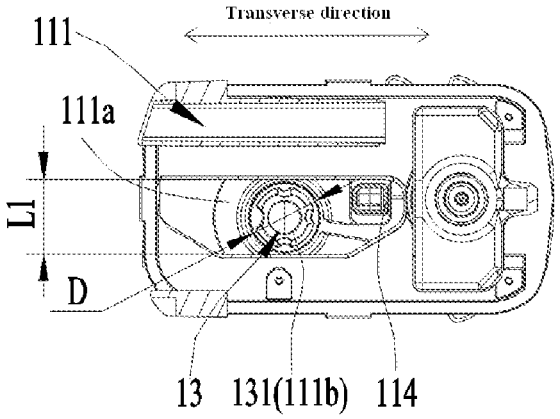
FIG. 6 is a cross-sectional view taken along the line B-B shown in FIG. 3.

In an embodiment of the disclosure, referring to FIG. 5 and FIG. 6, the atomizing assembly mounting hole 111*b* is located at a bottom of the second receiving cavity 111*a*. A maximum width L2 of the first receiving cavity 1101*a* and a maximum width L1 of the second receiving cavity 111*a* are adapted to a maximum outer diameter D of the atomizing assembly mounting hole 111*b*. That is, the maximum width L1 of the second receiving cavity 111*a* should be as close as possible to the maximum outer diameter D of the atomizing assembly mounting hole 111*b*, but it should be ensured that there is sufficient mounting clearance in the second receiving cavity 111*a* when the oscillating plate 131 is mounted. Moreover, the maximum width L2 of the first receiving cavity 1101*a* corresponds to the maximum width L1 of the second receiving cavity 111*a*, and a maximum length L3 of the first receiving cavity 1101*a* is greater than the maximum width L2 of the first receiving cavity 1101*a*, whereby the first receiving cavity 1101*a* can be narrowed as much as possible to ensure that sufficient air pressure can be generated in the first receiving cavity 1101*a*. The maximum length L3 of the first receiving cavity 1101*a* in the embodiment of the disclosure is about three times the maximum width L2 of the first receiving cavity 1101*a*, so that the first receiving cavity 1101*a* is an overall elongated structure. In another embodiment, the width of the first receiving cavity 1101*a* may also taper from one end in communication with the second receiving cavity 111*a* to another end away from the second receiving cavity 111*a* without affecting the communication between the first receiving cavity 1101*a* and the second receiving cavity 111*a*, and without affecting the generation of the mist column by the oscillating plate 131.

Figure 4:
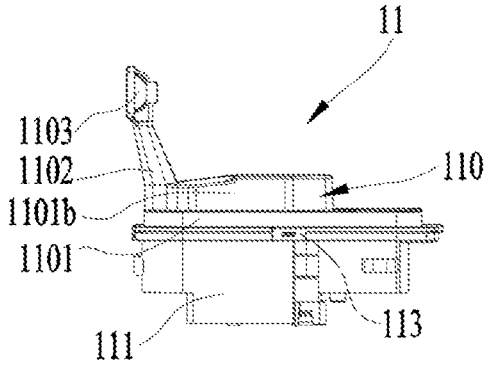
FIG. 4 is a schematic diagram of a water box in FIG. 1.

One embodiment of the disclosure provides a water box 11. Referring to FIG. 4 and FIG. 6, the water box further includes a box body 111, an air-out duct 114 and a box cover 110 as described above. The box body 111 is provided with a second receiving cavity 111*a* and an atomizing assembly mounting hole 111*b* in communication with the second receiving cavity 111*a*. The box cover 110 is capped on the box body 111, the mist output channel 1102 and the air-out duct 114 is in communication with the second receiving cavity 111*a*. Herein, an air outlet 114*a* of the air-out duct 114 is disposed higher than a water level of the liquid water in the second receiving cavity 111*a*.

In an embodiment of the disclosure, referring to FIG. 3, after the box cover 110 is capped on the box body 111, the position of the first receiving cavity 1101*a* corresponds to the position of the second receiving cavity 111*a*. The first receiving cavity 1101*a* and the second receiving cavity 111*a* together form a space where the water mist is generated, and the air-out duct 114 extends into the first receiving cavity 1101*a* to ensure that sufficient air pressure can be generated in the first receiving cavity 1101*a*. The box cover 110 can be fixed to the box body 111 by screws, the box cover 110 and the box body 111 can be sealed by a sealing ring 112, and the periphery of the box cover 110 and the box body 111 can be reinforced and fixed by a clamping assembly 113.

The atomizing assembly mounting hole 111*b* is configured to mount the atomizing assembly 13, and the fan assembly 14 is in communication with both the first receiving cavity 1101*a* and the second receiving cavity 111*a* through the air-out duct 114. In an embodiment of the disclosure, the fan assembly 14 is a blower. In another embodiment, the fan assembly 14 may also be an axial fan, a centrifugal fan, a cross-flow fan, or the like.

In use, the liquid water enters the second receiving cavity 111*a* through the water tank 12. The atomizing assembly 13 generates water mist by breaking the liquid water, and then blows the water mist to the outside of the fan heater by using the air pressure generated by the fan assembly 14 in the first receiving cavity 1101*a*.

In order to prevent water from splashing into the fan assembly 14 through the air-out duct 114, and causing short circuit of the fan assembly 14, in an embodiment of the disclosure, referring to FIG. 2 and FIG. 3, an air-in end of the air-out duct 114 penetrates through a bottom of the second receiving cavity 111*a*, and an air-out end of the air-out duct 114 is arranged corresponding to an inner surface of the cover body 1101. In one embodiment, on the premise that sufficient air pressure can be generated in the first receiving cavity 1101*a*, the air-out end of the air-out duct 114 can be as close as possible to the inner surface of the cover body 1101. In another embodiment, since the first receiving cavity 1101*a* is provided in the embodiment, the air outlet 114*a* is actually located close to the inner surface of the top of the protrusion 1101*b*. Further, the air-out duct 114 is located on one side of the atomizing assembly mounting hole 111*b* and the mist output channel 1102 is located on another side of the atomizing assembly mounting hole 111*b* transversely opposite to said one side. The air outlet 114*a* of the air-out duct 114 is provided on one side facing away from the mist output channel 1102, whereby an air-out direction is opposite to a mist output direction, and thus liquid water which is not atomized in the first receiving cavity 1101*a* can be better prevented from splashing into the fan assembly 14 through the air-out duct 114. In other embodiments, the position of the air-out duct 114 can be arbitrarily adjusted. For example, the air-out duct 114 can pass through the box cover 110 from the top of the box cover 110 and be in communication with the second receiving cavity 111*a*, or can pass through the second receiving cavity 111*a* from a side wall of the second receiving cavity 111*a*, as long as the air outlet 114*a* of the air-out duct 114 is higher than the water level of the liquid water in the second receiving cavity.

One embodiment of the disclosure provides a humidifying device 10. Referring to FIG. 4 to FIG. 6, the humidifying device 10 includes an atomizing assembly 13, a water tank 12, a fan assembly 14 and a water box 11 as described above. The atomizing assembly 13 is disposed at the atomizing assembly mounting hole 111*b*. A water-passage hole 111*c* is formed on the water box, and the water tank 12 is in communication with the second receiving cavity 111*a* through the water-passage hole 111*c*. The fan assembly 14 is in communication with the air-out duct 114.

Figure 7:
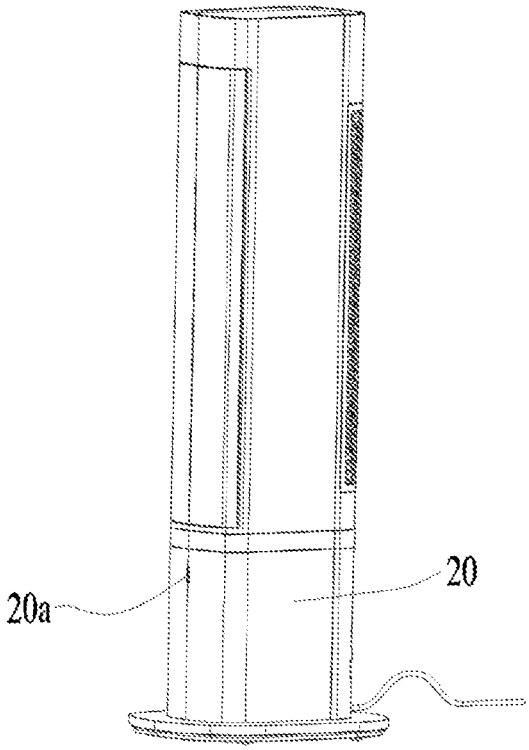
FIG. 7 is a schematic diagram of a blowing apparatus according to an embodiment of the disclosure.

Another embodiment of the disclosure provides a blowing apparatus. Referring to FIG. 7 and FIG. 8, the blowing apparatus includes a housing 20 and a humidifying device 10 as described above. A mist output hole 20*a* is arranged on the housing 20, the humidifying device 10 is arranged in the housing 20, and the mist output channel 1102 is in communication with the mist output hole 20*a*. The water mist generated by the humidifying device 10 can be blown to the outside of the blowing apparatus through the mist output hole 20*a*.

What is claimed is:

1. A water box of a humidifying device, the water box comprising a box body, an air-out duct and a box cover; wherein the box cover comprises a cover body and a mist output channel penetrating through the cover body;

the cover body is integrally formed with the mist output channel;

a protrusion provided with a first receiving cavity is formed on the cover body, the first receiving cavity is in communication with the mist output channel;

the box cover further comprises a plurality of drainage ribs, the plurality of drainage ribs are arranged on an inner surface of a top of the protrusion; and the mist output channel is provided at one side of the plurality of drainage ribs, and the air-out duct is provided at another side of the plurality of drainage ribs.

2. The water box of claim 1, wherein the box cover further comprises a mist outlet, a first end of the mist output channel is in communication with the cover body, a second end of the mist output channel is in communication with the mist outlet, the mist output channel is integrally formed with the mist outlet.

3. The water box of claim 2, wherein a cross section of the mist output channel tapers from the first end in communication with the cover body to the second end where the mist outlet is located.

4. The water box of claim 1, wherein the mist output channel is located on one side of the protrusion, the protrusion comprises a first top surface and a second top surface, one side of the second top surface is connected with the first top surface, another side of the second top surface is connected with a side wall of the mist output channel, the second top surface is inclined downward from said one side connected with the first top surface to said another side connected with the side wall of the mist output channel.

5. The water box of claim 4, wherein the plurality of drainage ribs are radially distributed.

6. The water box of claim 1, wherein the box body is provided with a second receiving cavity and an atomizing assembly mounting hole in communication with the second receiving cavity, the box cover is capped on the box body, the mist output channel and the air-out duct being in communication with the second receiving cavity; and an air outlet of the air-out duct is disposed higher than a highest water level of the second receiving cavity, and the air outlet of the air-out duct is higher than a lowest point of the plurality of drainage ribs.

7. The water box of claim 6, wherein a first air-in end of the air-out duct penetrates through a bottom of the second receiving cavity, and a second air-out end of the air-out duct is arranged corresponding to an inner surface of the cover body; and the air-out duct is located on one side of the atomizing assembly mounting hole and the mist output channel is located on another side of the atomizing assembly mounting hole transversely opposite to said one side, and the air outlet of the air-out duct faces away from the mist output channel.

8. A humidifying device, the humidifying device comprising an atomizing assembly, a water tank, a fan assembly and a water box according to claim 6, the atomizing assembly is disposed at the atomizing assembly mounting hole, a water-passage hole is formed on the water box, and the water tank being in communication with the second receiving cavity through the water-passage hole, the fan assembly is in communication with the air-out duct.

9. The humidifying device of claim 8, wherein the atomizing assembly mounting hole is located at a bottom of the second receiving cavity, a maximum width of the first receiving cavity and a maximum width of the second receiving cavity are adapted to a maximum outer diameter of the atomizing assembly mounting hole, a maximum length of the first receiving cavity is greater than the maximum width of the first receiving cavity.

10. A blowing apparatus, comprising a housing and a humidifying device according to claim 8, the humidifying device being arranged in the housing, a mist output hole being arranged on the housing, and the mist output channel being in communication with the mist output hole.

* * * * *